US006446732B1

(12) United States Patent
Polan

(10) Patent No.: US 6,446,732 B1
(45) Date of Patent: Sep. 10, 2002

(54) VELO ECOH SPRINKLER ARRANGEMENT

(75) Inventor: George S. Polan, Perkiomenville, PA (US)

(73) Assignee: The Reliable Automatic Sprinkler Company, Inc., Mount Vernon, NY (US)

( * ) Notice: Subject to any disclaimer, the term of this patent is extended or adjusted under 35 U.S.C. 154(b) by 0 days.

(21) Appl. No.: 09/689,465

(22) Filed: Oct. 12, 2000

(51) Int. Cl.[7] ..... A62C 37/08
(52) U.S. Cl. ..... 169/37; 239/498; 169/57
(58) Field of Search ..... 169/57, 37, 90, 169/38, 39, 40, 41, 42; 239/498, 504

(56) References Cited

U.S. PATENT DOCUMENTS

| | | | | |
|---|---|---|---|---|
| 2,025,063 A | | 12/1935 | Loepsinger | |
| 2,046,169 A | | 6/1936 | Knight | |
| 2,101,694 A | | 12/1937 | Tyden | |
| 2,135,138 A | | 11/1938 | Kendall | |
| 4,014,388 A | * | 3/1977 | Anderson | 129/37 |
| 4,029,150 A | * | 6/1977 | Goodsell, Jr. | 169/37 |
| 4,585,069 A | | 4/1986 | Whitaker | |
| 5,366,022 A | | 11/1994 | Meyer et al. | |
| 5,494,113 A | * | 2/1996 | Polan | 169/37 |
| 5,579,846 A | | 12/1996 | Meyer et al. | |
| 5,584,344 A | | 12/1996 | Meyer et al. | |
| 5,609,211 A | | 3/1997 | Meyer et al. | |
| 5,839,667 A | | 11/1998 | Fishcer | |
| 5,862,994 A | | 1/1999 | Pounder et al. | |
| 5,865,256 A | * | 2/1999 | Pounder | 169/37 |
| 6,059,044 A | * | 5/2000 | Fischer | 169/37 |

FOREIGN PATENT DOCUMENTS

| | | |
|---|---|---|
| GB | 969923 | 9/1964 |

* cited by examiner

*Primary Examiner*—Henry C. Yuen
*Assistant Examiner*—Christopher Kim
(74) *Attorney, Agent, or Firm*—Baker Botts, LLP

(57) ABSTRACT

In the fire protection sprinkler arrangement described in the specification, a VELO ECOH has a sprinkler body with an axial passage for delivery of water and a deflector supported from the sprinkler body by a pair of frame arms. The deflector has a substantially planar central region and a peripheral portion bent toward the sprinkler body along a circular bend line at an angle of about 45° from the plane of the central region. The perimeter of the deflector has four arcuate segments disposed at 90° angles and four substantially straight line segments interposed between the arcuate segments and includes twelve slots extending inwardly from the perimeter. The slots adjacent to the arcuate segments extend approximately parallel to perpendicular axial planes intersecting those segments and the other slots extend radially inwardly from locations centered in the substantially straight line segments of the periphery.

16 Claims, 5 Drawing Sheets

140

| | | | | | | | Total GPM / row |
|---|---|---|---|---|---|---|---|
| 0.25 | 0.21 | 0.25 | 0.27 | 0.17 | 0.1 | 0.05 | 1.3 |
| 0.18 | 0.17 | 0.2 | 0.26 | 0.25 | 0.18 | 0.11 | 1.35 |
| 0.13 | 0.13 | 0.17 | 0.21 | 0.24 | 0.23 | 0.21 | 1.32 |
| 0.11 | 0.12 | 0.14 | 0.17 | 0.21 | 0.23 | 0.26 | 1.24 |
| 0.1 | 0.1 | 0.11 | 0.14 | 0.19 | 0.23 | 0.22 | 1.09 |
| 0.08 | 0.09 | 0.1 | 0.11 | 0.15 | 0.21 | 0.22 | 0.96 |
| 0.08 | 0.08 | 0.09 | 0.1 | 0.13 | 0.2 | 0.26 | 0.94 |
| | | | | | | | 8.2 (overall) |

3.03

FIG. 5A

140

| | | | | | | | Total GPM / row |
|---|---|---|---|---|---|---|---|
| 0.1 | 0.1 | 0.13 | 0.2 | 0.22 | 0.24 | 0.23 | 1.22 |
| 0.12 | 0.15 | 0.12 | 0.14 | 0.16 | 0.19 | 0.2 | 1.08 |
| 0.15 | 0.2 | 0.17 | 0.15 | 0.13 | 0.16 | 0.03 | 0.99 |
| 0.13 | 0.17 | 0.2 | 0.17 | 0.12 | 0.11 | 0.09 | 0.99 |
| 0.14 | 0.12 | 0.14 | 0.15 | 0.12 | 0.12 | 0.1 | 0.89 |
| 0.13 | 0.08 | 0.09 | 0.12 | 0.15 | 0.14 | 0.13 | 0.84 |
| 0.13 | 0.08 | 0.08 | 0.13 | 0.15 | 0.21 | 0.22 | 1 |
| | | | | | | | 7.01 (overall) |

2.23

FIG. 5B

VELO ECOH SPRINKLER ARRANGEMENT

BACKGROUND OF THE INVENTION

This invention relates to fire protection sprinkler arrangements and, more particularly, to sprinkler arrangements utilizing very extra large orifice (VELO) sprinklers for extended coverage ordinary hazard (ECOH) applications.

The National Fire Protection Association (NFPA) promulgates standards for automatic fire sprinkler systems of various types and categories of protected materials including those designated as ordinary hazards (OH). Extended coverage (EC) sprinklers are intended for use to cover areas of 16' by 16' up to 20' by 20' per sprinkler. For such applications the water distribution density over the area to be protected should be substantially uniform in order to obtain the best protection. Certifying organizations such as Underwriters Laboratories, Inc. and Factory Mutual Research Corporation conduct tests to determine whether sprinklers satisfy requirements of the NFPA standards in accordance with established procedures. Among the most difficult requirements to satisfy are uniformity of distribution at spacings of 3' and 7' 6" below the sprinklers for ECOH sprinklers intending to cover areas of 16' by 16', 18' by 18' and 20' by 20'.

The size of the passage opening or "orifice" in a sprinkler body through which the water passes determines, together with the water pressure, the rate at which water is applied to the areas to be protected. A one-half inch orifice has been called a "standard" orifice; a five-eighths inch orifice is called an "extra large" orifice, and an eleven sixteenths inch or larger orifice has been designated a "very extra large orifice" (VELO). Such sprinklers have nominal K factors, corresponding to the flow rate in gallons per minute divided by the square root of the water pressure, of 5-½, 11 and 14 or more, respectively. The water distribution pattern produced by a sprinkler depends to a large extent on the arrangement of the deflector against which the water is directed when it emerges from the orifice.

The Meyer et al. U.S. Pat. Nos. 5,366,022 and 5,579,846 disclose ECOH sprinklers having deflectors in the form of a flat or slightly angled disc with radial slots of alternately different length extending inwardly from the periphery of the disc. The Meyer et al. U.S. Pat. No. 5,609,211 discloses an ECOH sprinkler having a deflector with a circular periphery and a plurality of radial slots of uniform length extending inwardly from the periphery in an outer region which is bent downwardly at a uniform angle from the central portion of the disc providing a cone angle of about 90°, i.e., about 45° from the horizontal.

The Pounder et al. U.S. Pat. No. 5,862,994 discloses an ECOH sprinkler with a deflector having an inner surface with a recessed central area and a recessed redirecting area surrounding the central area and extending at an angle to the central area and peripheral tines having inner surfaces inclined at different angles to the axis of the sprinkler and also having different widths.

SUMMARY OF THE INVENTION

Accordingly, it is an object of the present invention to provide a VELO ECOH sprinkler arrangement which overcomes disadvantages of the prior art.

Another object of the invention is to provide a VELO ECOH sprinkler arrangement producing improved uniformity of distribution of water for extended coverage areas.

A further object of the invention is to provide a fire protection sprinkler arrangement which assures exceptional uniformity of water distribution at 16' by 16' to 20' by 20' coverage over hazards located at spacings of 3' and 7.5' below the sprinkler.

These and other objects of the invention are attained by providing a sprinkler arrangement with a sprinkler body having an axial passage for delivery of water and a deflector supported in spaced relation to the axial passage and disposed generally in a plane extending perpendicular to the axis of the passage in which a peripheral portion of the deflector is bent toward the sprinkler body about a circle and the perimeter of the deflector has chordal segments defined by planes extending substantially parallel to the axis of the sprinkler body. In addition, a plurality of slots extend inwardly from the perimeter of the deflector to a substantially uniform spacing from the axis of the sprinkler defining between them tines of differing length. Preferably the deflector is supported from the sprinkler body by a pair of frame arms disposed in a plane containing the sprinkler axis and includes tines in the plane of frame arms and tines in an axial plane extending perpendicular to that plane which are wider than the other tines and has slots adjacent to those tines which are directed parallel to the plane of the frame arms or to the plane perpendicular thereto.

In a preferred embodiment the sprinkler has a K factor of at least 14 and the deflector has a projected maximum diameter of about 1.66 inches and the spacing between opposed chordal perimeter segments is about 1.51 inches while the radius of the circle at which the deflector periphery is bent downwardly is about 1.35 inches.

BRIEF DESCRIPTION OF THE DRAWINGS

Further objects and advantages of the invention will be apparent from a reading of the following description in conjunction with the accompanying drawings in which:

FIG. 5A is a chart illustrating the water distribution pattern produced by a representative sprinkler arrangement according to the invention; and FIG. 5B is a chart illustrating a water distribution pattern produced by a conventional sprinkler.

DESCRIPTION OF PREFERRED EMBODIMENTS

Figure 1:
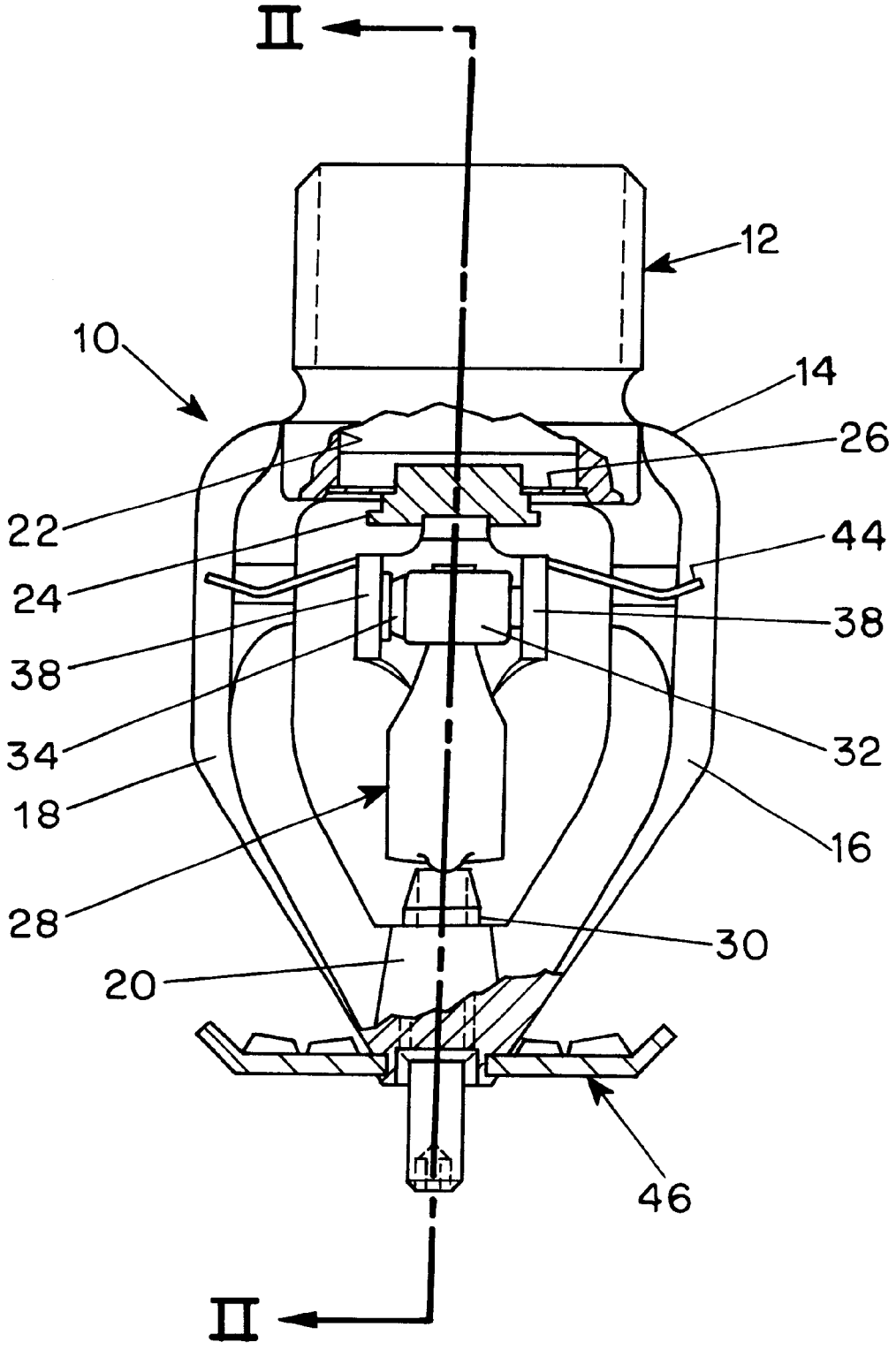
FIG. 1 is a side view, partly in section, illustrating a representative embodiment of a VELO ECOH sprinkler arrangement according to the invention.
Figure 2:
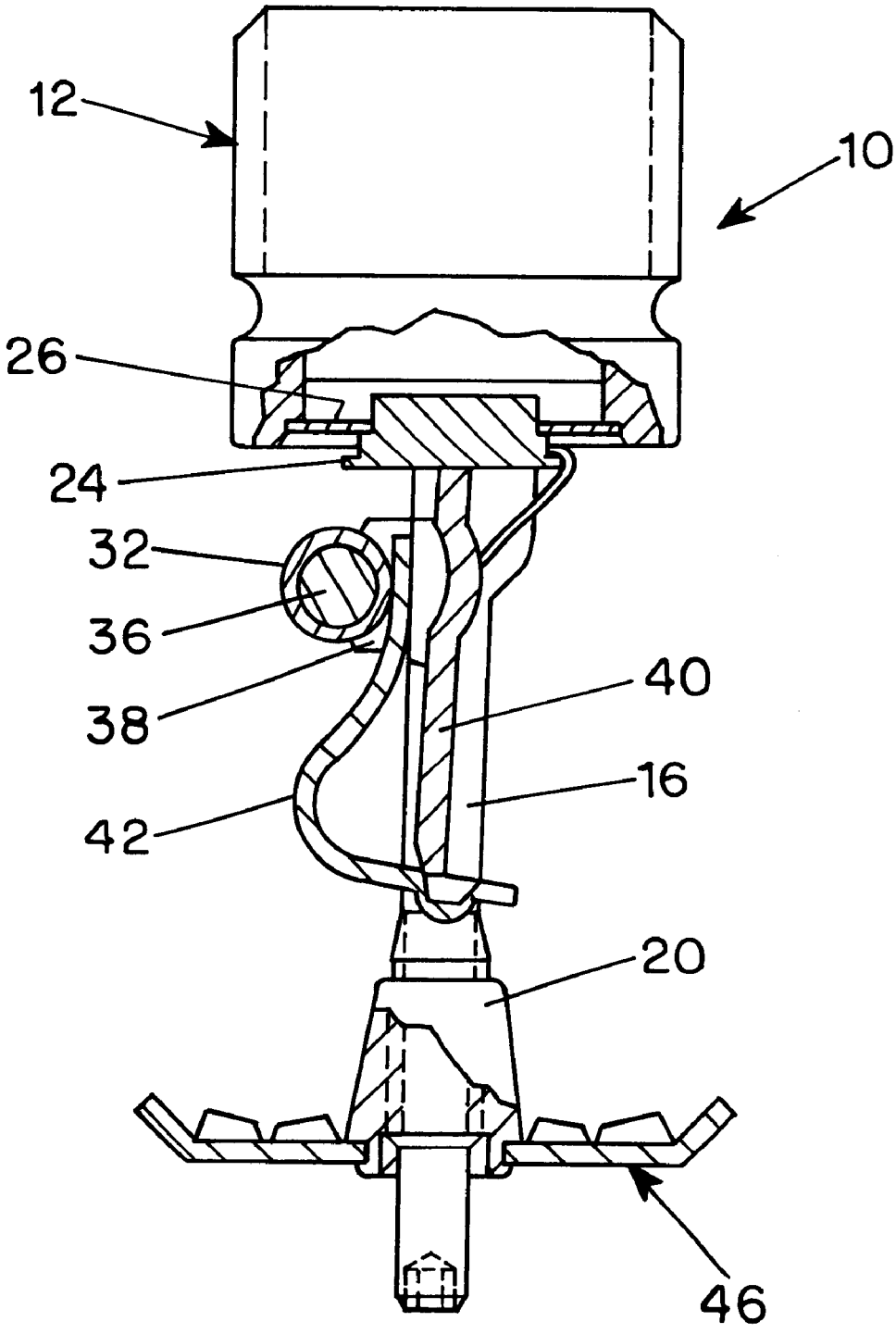
FIG. 2 is a cross-sectional view taken on the line II—II of FIG. 1 and looking in the direction of the arrows.
Figure 3:
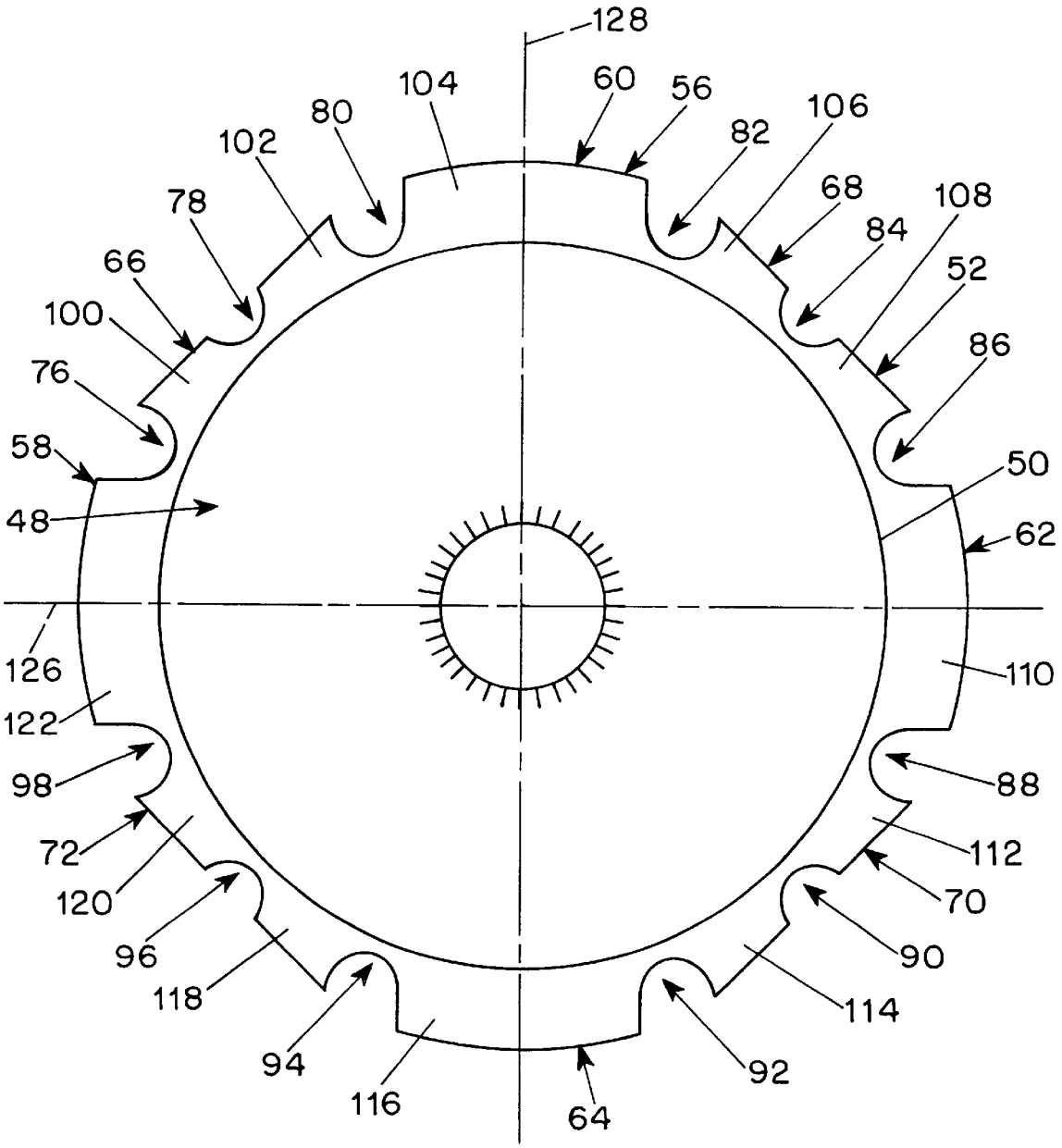
FIG. 3 is an end view of the sprinkler shown in FIGS. 1 and 2 illustrating a plan of the deflector.

The typical embodiment of a VELO ECOH sprinkler 10 according to the invention shown in FIGS. 1–3 has a sprinkler body 12 with a threaded end adapted to be connected to a pipe arranged to supply water under pressure and a frame 14 consisting of two arms 16 and 18 extending from opposite sides of the sprinkler body 12 and joined at a boss 20 which is positioned on the sprinkler axis and spaced from the sprinkler body 12. The sprinkler body 12 is formed with an axial internal passage 22 to direct a stream of water under pressure axially toward the boss 20 and is normally closed by a sealing cap 24 received in a washer 26 which is seated on a shoulder of the passage 22. The sealing cap 24 is retained in its passage-closing position by a conventional thermally responsive arrangement 28 which extends between the cap 24 and the end of a screw 30 threaded through the boss 20. Typically, the sprinkler body provides a K factor of about 14 but the invention is also useful with sprinklers having a higher K factor.

In the illustrated embodiment, the thermally responsive arrangement 28 includes a cylinder 32 containing a ball 34 at one end which is held in position by a fusible element such as block 36 of solder arranged to be fused at a selected elevated temperature such as 165° F. (74° C.). In the unfused condition illustrated in FIGS. 1 and 2, the cylinder 32 is retained between projecting arms 38 on a strut member 40 to restrain a lever member 42 in a strut-supporting position so as to hold the cap 24 and its associated washer 26 in the passage-closing position. When the solder fuses in response to an elevated temperature the cylinder 32 is released from the arms 38 of the strut 40 permitting the lever 42 to pivot outwardly, thereby releasing the strut from its cap retaining position. If desired, the thermally responsive fusible element 36 may be fusible at a higher temperature such as 212° F. (100° C.) or 286° F. (141° C.). Alternatively, any other conventional temperature responsive arrangement such as a soldered link or a glass bulb operable at 155° F. (68° C.), 175° F. (79° C.) or 200° F. (93° C.) may be substituted for the temperature responsive arrangement 28.

To facilitate removal of the strut and lever assembly from the path of water emerging from the passage 22, a spring 44 extending between the frame arms 16 and 18 engages the strut 40. The water projected axially through the passage 22 is therefore directed along an unimpeded path toward a deflector 46 which is mounted on the boss 20 and is arranged to divert the water radially outwardly so as to be dispersed over the region to be protected. If desired, the cap 24 may be asymmetrically shaped so as to be deflected laterally by the emerging water stream. In this case the spring 44 may be omitted. Moreover, for deluge-type applications, the flow of water through the sprinkler may be controlled by a remote valve in the water supply rather than a thermally responsive arrangement in this sprinkler.

In the illustrated embodiment as best seen in FIG. 3, the deflector 46 has a substantially planar central region 48 enclosed by a circle 50 at which an outer peripheral portion 52 is bent inwardly toward the sprinkler body 12. The perimeter 56 of the deflector has a squared circular configuration consisting of four arcuate portions 58, 60, 62 and 64 separated by four substantially straight line chordal portions 66, 68, 70 and 72. The peripheral portion 52 is bent downwardly from the central portion toward the sprinkler body 12 at an angle in a range from about 30° to about 50°, preferably about 35° to about 45°, and desirably about 40°. Distributed around the periphery of the deflector are twelve slots 76, 78, 80, 82, 84, 86, 88, 90, 92, 94, 96 and 98, the slots 78, 84, 90 and 96, which are in the center of each of the straight line portions 66, 68, 70 and 72, being shorter than the other slots. Disposed between adjacent pairs of slots are corresponding tines 100, 102, 104, 106, 108, 110, 112, 114, 116, 118, 120 and 122. Four of the tines 104, 110, 116 and 122, which are intersected by the plane 126 of the frame arms 16 and 18 and by a plane 128 perpendicular thereto, terminate in the arcuate portions 58, 60, 62 and 64 of the perimeter of the deflector. The slots 80, 82, 92 and 94, which are adjacent to the tines 104 and 116, extend generally parallel to the plane 128 and the slots 86, 88, 98 and 76, which are adjacent to the tines 112 and 122, extend generally parallel to the plane 126, whereas the other slots 78, 84, 90 and 96, which are centrally located in the straight line perimeter portions, extend substantially radially from the center of the deflector.

Figure 4:
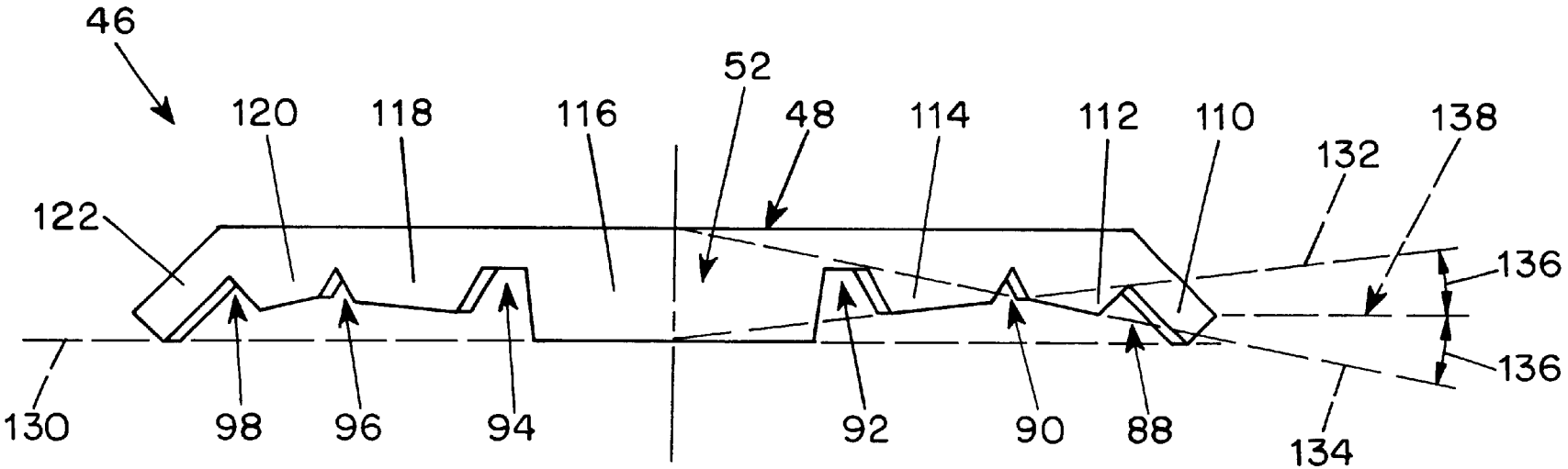
FIG. 4 is a side view of the deflector shown in FIG. 3.

As best seen in the side view of FIG. 4, the longer tines 104, 110, 116 and 122 extend downwardly away from the central portion 48 to a plane 130 which is parallel to the plane of the central region 48 whereas the shorter tines 100, 102, 106, 108, 112, 114, 118 and 120 extend downwardly to terminal edges which extend in planes 132 and 134 disposed at equal opposite angles 136 with respect to a plane 138 parallel to the plane 130. This angular termination of the short tines, which is at an angle in the range from about 5° to about 20°, preferably about 7° to about 12°, and desirably about 10°, results from the downward bending of the linear perimeter edges 66, 68, 70 and 72 of the deflector and facilitates generation of the required uniform water distribution and also creates a very shallow horizontal trajectory of the water pattern directed toward the critical area of coverage located centrally between adjacent sprinklers. In a preferred embodiment the four longer tines 104, 110, 116 and 122 have a width of about 0.45 inch and all of the other tines have a width of about one third to one half that of the longer tines, for example, 0.168 inch, at their base and approximately 0.18 inch at their perimeter edges. The diameter of the deflector between the arcuate perimeter portions prior to bending is about 1.70 inches and the diametric spacing of the linear perimeter portions is about 1.51 inches and, in the final condition of the deflector with the periphery bent downwardly toward the sprinkler body 12, the projected diameter is about 1.66 inches.

The deflector 46 may be fabricated either by forming the straight line perimeter portions 66, 68, 70 and 72 before the peripheral region 52 is bent downwardly along the line 50 or after the bend has been made. If the linear perimeter edges 66, 68, 70 and 72 are formed before bending of the peripheral portion, the projections of those edge portions on a plane parallel to that of the central region 48 will not be perfectly straight since the longer tine perimeter edge portions will move in a direction perpendicular to the straight line perimeter edge line to a slightly greater extent than the shorter perimeter edge tine portions but nevertheless the resulting tines provide the desired distribution as discussed above to the same extent as if the linear perimeter edges have been cut in a straight line after the peripheral portion has been bent downwardly. In this regard, those perimeter edge portions are "substantially straight" as used herein and in the appended claims.

FIG. 5A shows a floor collection pattern for a sprinkler arrangement according to the invention arranged for 20' by 20' coverage with a 3' gap between the sprinklers and the collection pans at a 60 gallon per minute headflow. The illustrated collection pattern shows the result in one 10'×10' quadrant of the 20'×20' area between a sprinkler 140 at the upper right hand corner and the center of the 20'×20' area protected by four such sprinklers, one at each corner. Each pan was 1 foot square and the pans were spaced from each other by one half foot in the pattern. It should be noted that the sixteen pans in the lower right hand corner of the illustrated pattern, i.e., those nearest the center of the area to be protected, collected a total of 3.03 gallons per minute, showing above-average distribution in the most important areas to be protected.

In contrast, FIG. 5B shows the result using a sprinkler having a conventional flat deflector under otherwise identical conditions. In this case, the sixteen pans in the lower right hand corner collected a below average distribution of 2.23 gallons per minute.

Furthermore, in the 350 pound wood crib fire tests specified in the UL199 Standard, the sprinklers of the invention at 20'×20' spacing extinguished the fires with only 9.1% weight loss at 240 gallons per minute and 6.6% weight loss at 320 gallons per minute and, at 16'×16' spacing, with only 6.3% weight loss at 156 gallons per minute and 5% weight loss at 204 gallons per minute, which is substantially less than the 20% maximum weight loss requirement of the standard.

Although the invention has been described herein with reference to specific embodiments, many modifications and variations therein will readily occur to those skilled in the art. Accordingly, all such variations and modifications are included within the intended scope of the invention.

I claim:

1. A fire protection sprinkler arrangement comprising:

a sprinkler body having an axial passage for delivery of water; and a deflector supported from the sprinkler body in axially spaced relation to the passage and in a plane generally perpendicular to the axis of the sprinkler body;

the deflector having a central region and a peripheral region surrounding the central region which is bent toward the sprinkler body along a circular bend line and has an outer perimeter with a plurality of substantially straight linear perimeter segments joined by arcuate perimeter segments, the arcuate perimeter segments conforming substantially to the perimeter of a circle centered on the sprinkler axis.

2. A fire protection sprinkler arrangement according to claim 1 wherein the axial passage in the sprinkler body has an orifice size of eleven sixteenths inch or larger.

3. A fire protection sprinkler arrangement according to claim 1 wherein the peripheral region is bent toward the sprinkler body at an angle in the range from about 30° to about 50° from a plane perpendicular to the sprinkler axis.

4. A fire protection sprinkler arrangement according to claim 3 wherein the peripheral region is bent toward the sprinkler body at an angle in the range from about 35° to about 45° from a plane perpendicular to the sprinkler axis.

5. A fire protection sprinkler arrangement according to claim 4 wherein the peripheral region of the deflector is bent toward the sprinkler body at an angle of about 40° from a plane perpendicular to the sprinkler axis.

6. A fire protection sprinkler arrangement according to claim 1 wherein the peripheral region of the deflector has plurality of slots extending inwardly from the perimeter and separating the peripheral region into a plurality of intervening tines.

7. A fire protection sprinkler arrangement according to claim 6 including a first plurality of tines having outer edges extending along the arcuate perimeter segments of the deflector and a second plurality of tines having outer edges extending along the substantially straight linear perimeter segments of the deflector.

8. A fire protection sprinkler arrangement according to claim 7 wherein the first plurality of tines comprises four tines spaced at 90° angles around the periphery of the deflector and wherein the slots adjacent to those tines extend substantially parallel to planes intersecting the diametrically opposite tines of the first plurality.

9. A fire protection sprinkler arrangement according to claim 8 wherein the second plurality of tines includes four pairs of tines, each pair being disposed between two adjacent tines of the first plurality and being separated by a substantially radially extending slot.

10. A fire protection sprinkler arrangement according to claim 9 wherein the edges of each pair of tines of the second plurality extend at opposite angles to each other with respect to a plane perpendicular to the axis of the sprinkler.

11. A fire protection sprinkler arrangement according to claim 10 wherein the opposite angles are substantially equal and are within a range from about 5° to about 20°.

12. A fire protection sprinkler arrangement according to claim 11 wherein the opposite angles are substantially equal and are within a range from about 7° to about 12°.

13. A fire protection sprinkler arrangement according to claim 12 wherein the opposite angles are substantially equal and are about 10°.

14. A fire protection sprinkler arrangement according to claim 10 wherein the tines of the first plurality have a width which is greater than that of the tines of the second plurality.

15. A fire protection sprinkler arrangement according to claim 14 wherein the width of the tines of the first plurality is approximately two to three times that of the width of the tines of the second plurality.

16. A fire protection sprinkler arrangement comprising:

a sprinkler body having an axial passage for delivery of water; and a deflector supported from the sprinkler body in axially spaced relation to the passage and in a plane generally perpendicular to the axis of the sprinkler body;

the deflector having a central region and a peripheral region surrounding the central region which is bent toward the sprinkler body and has an outer perimeter with a plurality of substantially straight linear perimeter segments joined by arcuate perimeter segments, the arcuate perimeter segments conforming substantially to the perimeter of a circle centered on the sprinkler axis, including a pair of frame arms extending from the sprinkler body and supporting the deflector in spaced relation to the sprinkler body, a first plurality of tines formed in the peripheral region of the deflector each having one of the arcuate perimeter segments and a second plurality of tines formed in the peripheral region of the deflector each having one of the substantially straight linear perimeter segments, two opposed tines of the first plurality being intersected by a plane extending through the frame arms and two other tines of the first plurality being intersected by a plane extending substantially perpendicular to the plane extending through the frame arms.

* * * * *